US005254035A

United States Patent [19]

Kiuchi

[11] Patent Number: 5,254,035

[45] Date of Patent: Oct. 19, 1993

[54] AUTOMATIC OPERATION APPARATUS FOR VENTILATING FAN

[75] Inventor: Migifumi Kiuchi, Kasugai, Japan

[73] Assignee: Matsushita Seiko Co., Ltd., Osaka, Japan

[21] Appl. No.: 960,054

[22] Filed: Oct. 14, 1992

[30] Foreign Application Priority Data

Oct. 18, 1991 [JP] Japan ..... 3-270751

[51] Int. Cl.[5] ..... F24F 11/00

[52] U.S. Cl. ..... 454/343; 417/12; 417/14; 417/63

[58] Field of Search ..... 417/12, 14, 63; 454/357, 342, 343

[56] References Cited

U.S. PATENT DOCUMENTS 3,672,128 6/1972 Heffron ..... 417/363

3,826,180 7/1974 Hayashi ..... 454/342

FOREIGN PATENT DOCUMENTS 62-119338 5/1987 Japan .

*Primary Examiner*—Richard A. Bertsch

*Assistant Examiner*—David W. Scheuermann

*Attorney, Agent, or Firm*—Stevens, Davis, Miller & Mosher

[57] ABSTRACT

In an apparatus in which a smoke density detecting element detects a smoke density in a room to be ventilated so as to automatically start and stop the operation of a ventilating fan in dependence upon whether the smoke density is higher than a predetermined value or not, if a difference between an actual output from the smoke density detecting element and an initial value thereof exceeds a set value, the operation of the ventilating fan is started, but if the difference therebetween becomes lower than the set value, the operation of the ventilating fan is stopped so as to absorb nonuniform measuring accuracy by the smoke density, and further, if the difference therebetween does not become higher or lower than the set value even though a predetermined time elapses after the operation of the ventilating fan is started or stopped, the set value is changed so as to cope with the atmosphere of the inside of the room to the ventilated.

3 Claims, 8 Drawing Sheets

AUTOMATIC OPERATION APPARATUS FOR VENTILATING FAN

BACKGROUND OF THE INVENTION

The present invention relates to an automatic operation apparatus for a ventilating fan in order to discharge cigarette smoke or the like from a room or the like.

RELATED ART

These years, there have been prosperously available ventilating fans incorporating an automatic operating apparatus for automatically operating the fan in response to the presence of cigarette smoke or the like in a room so as to cope with a change in the atmosphere of the room.

An automatic operation apparatus of the above-mentioned kind, as shown in FIGS. 7 and 8, includes a smoke density detection element 105 for detecting a density of smoke in a room 101, which is provided in the vicinity of the suction port 104 of a ventilating fan 103 that is mounted at the ceiling of the room 102. The smoke density detecting element 105 incorporates a sensing element 107 and a heater 107 for heating the sensing element 107 so as to maintain the temperature of the same at a predetermined value (about 300 deg. C.) in order to enhance the sensitivity for detection. As shown in FIG. 9, when smoke occurs in the room so as to gradually increase the density of smoke in the room 101, if a detection signal from the smoke density detecting element 105 indicates that the smoke density exceeds a predetermined reference value X ppm, the ventilating fan 103 is operated at a time Ta, and accordingly, contaminated air is discharged outside of the room through the suction port 104. Further, after the smoke density in the room 101 is lowered under ventilating operation of the fan 103 with elapse of the time, when a detection signal from the smoke density detection element 105 indicates that the smoke density becomes lower than the predetermined reference value X ppm, the ventilating fan 103 is stopped at a time Tb.

By the way, the detecting sensitivity characteristics of smoke density detection elements 105 used in the above-mentioned automatic operation apparatus for ventilating fans, are individually different from each other within a certain range, and accordingly the characteristics A, B of detection signals detected thereby differ from each other as shown in FIG. 9. A certain detection element used in the apparatus cannot precisely detect an actual smoke density in the room 101. In the above-mentioned conventional automatic operation apparatus for a ventilating fan, since a variation in a detection signal from the smoke density detection element 105 is compared with a predetermined reference value X ppm so as to start and stop the operation of the ventilating fan 103, if a smoke density detecting element having a detection sensitivity characteristic as shown by A in FIG. 9 is used, although the smoke density exceeds the predetermined reference value X ppm, the detection signal insufficiently increases when smoke is generated in the room 101, and accordingly, the ventilating fan 103 is not operated. Further, if a smoke density detecting element having a detection sensitively characteristic as shown by B in FIG. 9 is used, although the smoke density does not exceeds the reference value X ppm, the detection signal excessively increases when smoke is generated in the room 101, and accordingly, the ventilating fan is operated. Further, since the smoke density detection element 105 is located in the vicinity of the suction port 104 of the ventilating fan 103, it is exposed to contaminated air always when the contaminated air is discharged outside of the room through the operation of the ventilating fan 103. The temperature of the atmosphere surrounding the smoke density detection element 105 abruptly varies when an air stream generates or ceases, or when the operation of the ventilating fan is started or stopped, and accordingly, the temperature of the sensing element 106 incorporated in the detection element 105 is changed, causing a time lag with which the heater 107 returns the temperature of the sensing element 106 to a predetermined temperature (about 300 deg. C.). As a result, a smoke density Xa which is lower than an actual value is detected at the time Ta of starting of the operation of the ventilating fan, as shown in FIG. 9, and accordingly, the operation of the ventilating fan is once stopped. Alternatively, a smoke density Xb which is higher than an actual value is detected at the time Tb of stopping the ventilating fan, and accordingly, the operation of the ventilating fan is once started. Further, if the room 101 in which the ventilating fan 103 is installed has a wide space, or if the position of the installed ventilating fan 103 is high so that a position where smoke is generated, has a long distance from the ventilating fan 103, the smoke cannot reach the detecting element 103, or a difference in smoke density occurs between the area around the user and that around the detecting element 103. In such a case, even though air is contaminated in the area around the user, the ventilating fan 103 remains stopping so that the ventilation cannot be made coping with the atmosphere surrounding the user. Further, if the room in which the ventilating fan 103 is installed has a narrow space, or the position of the installed ventilating fan 103 is low so that the distance between the smoke detecting element 102 and the source of smoke is very short, generated smoke is readily sucked around the smoke density detecting element 105 and is then discharged outside of the room through the operation of the ventilating fan 103 with no time for diffusion of the smoke into the air in the room 101 or a difference in smoke density occurs between the area surrounding the user and the area around the detecting element 105. In this case, the operation of the ventilating fan 103 is maintained even though the air around the user is not contaminated. Thus, the ventilation coping with the atmosphere in which the user is present, cannot be made well.

SUMMARY OF THE INVENTION

The present invention is to devised in order to solve the above-mentioned problems, and accordingly, a first object of the present invention is to provide an automatic operation apparatus for operating a ventilating fan, precisely in accordance with a density of generated smoke so as to appropriately start or stop the operation of the ventilating fan even though the sensing characteristic of the smoke density detection element differs individually from that of another one. Further this apparatus can prevent the temperature of the atmosphere surrounding the smoke density detecting element from abruptly varying so as to erroneously operate the ventilating fan upon starting or stopping of the ventilating fan.

Further, a second object of the present invention is to provide an automatic operation apparatus for a ventilating fan with which ventilation can be made coping with an atmosphere surrounding the user even though the distance between the smoke density detecting element and the source of smoke is long so that the generated smoke cannot reach the detecting element or a difference in smoke density occurs between the area surrounding the user and the area around the detecting element since the room in which the ventilating fan is installed has a wide space or since the position of the installed density detecting element is high.

Further, a third object of the present invention is to provide an automatic operation apparatus for a ventilating fan with which ventilation can be made coping with an atmosphere surrounding the user even though the distance between the smoke density detecting element and the source of smoke is relatively short so that the generated smoke is soon discharge outside of the room by way of the area surrounding the smoke density detecting element with no time for diffusion of the generated smoke into the air in the room or a difference in smoke density occurs between the area surrounding the user and the area around the smoke density detecting element since the room in which the ventilating fan is installed has a narrow space or since the position of the installed ventilating fan is low.

In order to attain the first object, according to the first aspect of the present invention, there is provided an automatic operation apparatus for a ventilating fan comprising: a smoke density detection element for detecting a smoke density in a room; a smoke density measuring means for measuring a detection output from the smoke density detection element for every predetermined time; a first smoke density variation computing means for computing a variation in smoke density from a smoke density measured by the smoke density measuring means at that time and an initially measured smoke density used as a reference value; an operation starting means for starting operation of a ventilating fan when the variation measured by said first smoke density variation computing means exceeds a first set value; a reference value setting means for storing therein the initially measured smoke density as a reference value; an operation maintaining means for maintaining the operation of the ventilating fan, irrespective of a detection output from the smoke density measuring element, until a predetermined time elapses after the operation of the ventilating fan is started; a second smoke density variation computing means for computing a variation in smoke density from a smoke density measured by the smoke density measuring means and the reference value stored in the reference value setting means after the predetermined time elapses; an operation stopping means for stopping the operation of the ventilating fan when the variation computed by the second smoke density variation computing means becomes lower than a second set value; and a stop maintaining means for maintaining stopping of the operation of said ventilating fan, irrespective a detection output from the smoke density detecting element until a predetermined time elapses after the operation of the ventilating fan is stopped by the operation stopping means.

In order to attain the second object, according to the second aspect of the present invention, the above0mentioned automatic operation apparatus for a ventilating fan is further provided with a first set value correcting means for decreasing the first set value if the variation computed by said first smoke density variation computing means does not exceed said first set value so that said ventilating fan is maintained in a stopping condition for a predetermined time.

In order to attain the third object, in accordance with third aspect of the present invention, the above-mentioned automatic operation apparatus for a ventilating fan is further provided with a second set value correcting means for increasing the second set value if the variation computed by the second smoke density variation computing means does not become lower than the second set value so that the ventilating fan is maintained in an operating condition for a predetermined time.

In view of the above-mentioned arrangement according to first aspect of the present invention, even though the detection sensitive characteristic of an individual smoke density detection element used in the automatic operation apparatus for a ventilating fan differs individually from that of another one, the smoke density measuring means measures a detection output from the thus used smoke density detection element by every predetermined time, and the first smoke density variation computing means computes a variation from the measured smoke density at the instant time and an initially measured smoke density so that the operation starting means starts the operation of the ventilating fan when the variation exceeds a first set value while the reference value setting means stores therein the initially measured smoke density as a reference value. Then, the second smoke density variation computing means computes a smoke density variation from the reference value and a smoke density measured by the smoke density measuring means after the start of operation of the ventilating fan, and the operation stopping means stops the ventilating fan when this variation becomes below a second set value.

Further, although the temperature of the atmosphere surrounding the smoke density detection element abruptly varies upon starting of the ventilating fan so that the detection output from the smoke density detection element becomes nonuniform for a predetermined time, the operation maintaining means maintains the operation of the ventilating fan for a predetermined time, irrespective of the degree of the detection output of the smoke density detecting element within the predetermined time, and accordingly, it is possible to prevent the ventilating fan from being erroneously operated. Further, although the temperature of the atmosphere surrounding the smoke density detecting element abruptly varies upon stopping of the ventilating fan so that the detection output from the smoke density detection element becomes not uniform for a predetermined time, the stop maintaining means maintains stopping of the operation of the ventilating fan, irrespective of the degree of the detection output of the smoke density detection element within the predetermined time, thereby it is possible to prevent the ventilating fan from being erroneously operated.

Further, in view of the above-mentioned arrangement according to the second aspect of the present invention, if generated smoke does not reach the smoke density detection element or if a difference in smoke density occurs between the area surrounding the user and the area around the smoke density detection element so that the variation computed by the first smoke density variation computing means does not exceed the first set value since the distance between the smoke density detecting element and a source of smoke is long, the ventilating fan remains stopping for a predetermined time. In this case, the first set value correcting means decreases the first set value so that the variation computed by the first smoke density computing means can easily exceed the first set value, thereby it is possible to cope with an atmosphere in which the user is present.

Further, in view of the above-mentioned arrangement according to the third aspect of the present invention, if smoke is soon sucked by the ventilating fan by way of the area around the smoke density detection element with no time for diffusion of smoke into the air in the room, or if a difference in smoke density occurs between the area surrounding the user and the area around the smoke density detection element since the distance between the smoke density detection element and a source of smoke is short the variation computed by the second smoke density variation computing means does not become below the second set value so that the operation of the ventilating fan is maintained for a predetermined time. In this case the second set value correcting means increases the second set value so that the variation computed by the second smoke density variation computing means can easily become below the second set value, thereby it is possible to cope with the atmosphere surrounding the user.

Other features and advantages of the present invention will be apparent from the following description taken in connection with the accompanying drawing in which:

DESCRIPTION OF THE PREFERRED EMBODIMENTS OF THE PRESENT INVENTION

Explanation will be made of a first embodiment of the present invention with reference to FIG. 1.

Figure 1:
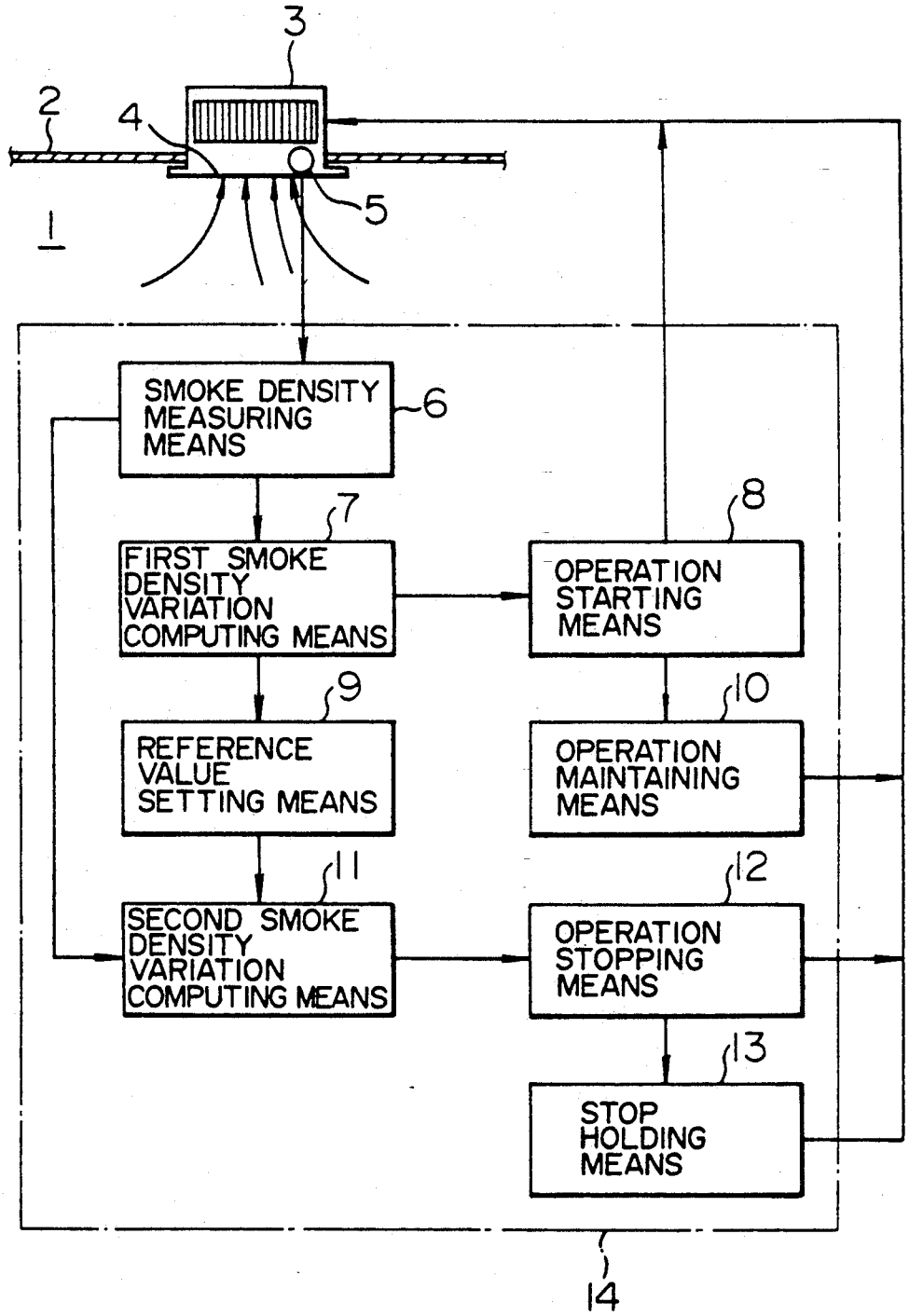
FIG. 1 is a block diagram showing an automatic operation apparatus for a ventilating fan in a first embodiment of the present invention.

As shown in FIG. 1, a smoke density detecting element 5 for detecting a smoke density in a room 1 is provided in the vicinity of a suction port 4 of a ventilating fan 3 installed at the ceiling surface 2 of the room 1. A smoke density measuring means 6 measures a detection output from the smoke density detecting element 5 at predetermined time intervals and delivers the thus measured detection output to a first smoke density variation computing means 7. The first smoke density variation computing means 7 computes a variation in smoke density from a smoke density measured at that moment by the smoke density measuring means 6 and an initial smoke density measured by the same which is used as a reference value, and delivers the thus computed value to an operation starting means 8 which starts the operation of the ventilating fan 3 when the variation in smoke density exceeds a first set value. Further, the initial smoke density measured by the smoke density measuring means 6 is stored as the reference value in a reference value setting means 9. Further, just after the start of the operation of the ventilating fan 3 by the operation starting means 8, the temperature of an atmosphere surrounding the smoke density detection element 5 abruptly varies so that the detection output from the smoke density detection element 5 becomes unstable for a predetermined time. However, an operation maintaining means 10 maintains the operation of the ventilating fan 3 for this predetermined time, irrespective of the degree of the detection output from the smoke density detection element 5. After the operation maintaining means 10 maintains the operation of the ventilating fan for the predetermined time, a second smoke density variation computing means 11 receives a smoke density measured by the smoke density measuring means 6 and the reference value from the reference value setting means 9, and computes a variation in smoke density from these values. The thus computed value is delivered to an operation stopping means 12 which stops the operation of the ventilating fan 3 when the smoke density variation computed by the second smoke density variation computing means 11 becomes below a second set value. Just after the stop of the operation of the ventilating fan 3 by the operation stopping means 12, the temperature of the atmosphere surrounding the smoke density detection element 5 abruptly varies so that the detection output of the smoke density detection element 5 becomes unstable for a predetermined time. However, a stop maintaining means 13 maintains the stopping of the operation of the ventilating fan 3 for this predetermined time, irrespective of the degree of the detection output from the smoke density detection element 5.

It is noted here that the smoke density measuring means 6, the first smoke density variation computing means 7, the operation starting means 8, the reference value setting means 9, the operation starting means 10, the second smoke density variation computing means 11, the operation stopping means 12 and the stop holding means 13 are all materialized by a microcomputer 14.

Figure 2:
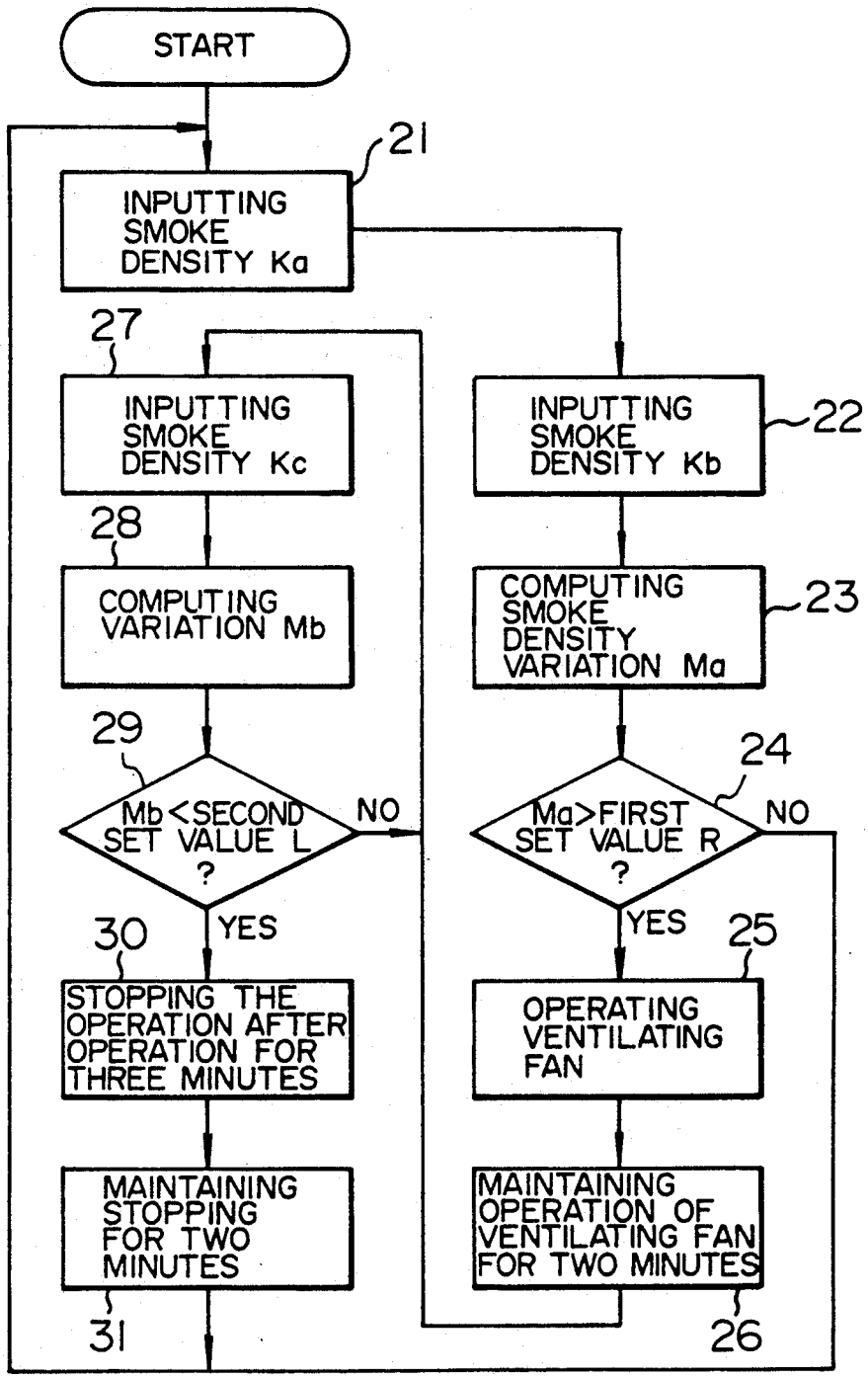
FIG. 2 is a flow chart explaining the operation program of the apparatus shown in FIG. 1.
Figure 3:
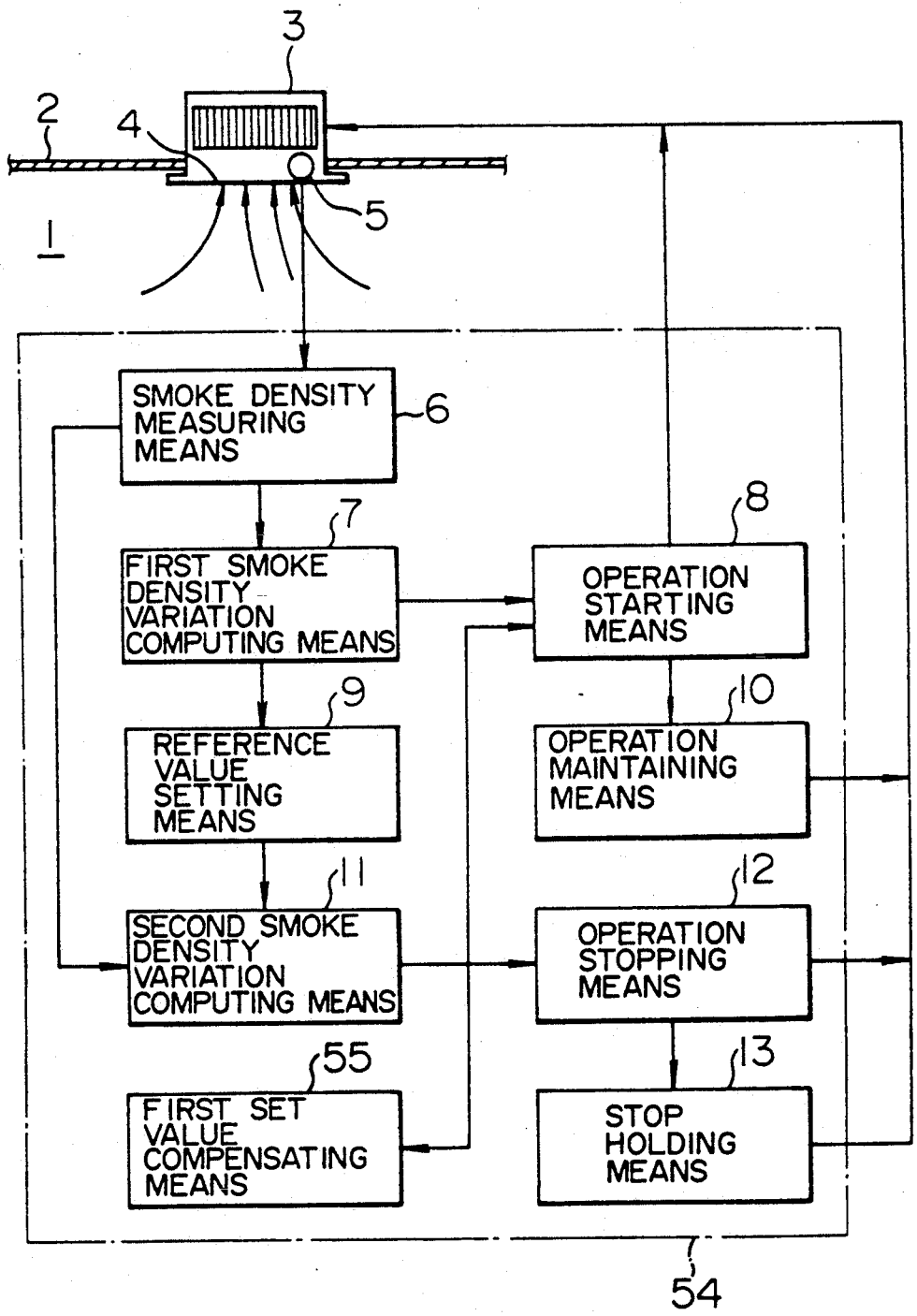
FIG. 3 is a block diagram showing an automatic operation apparatus in a second embodiment of the present invention.

Next, explanation will be made hereinbelow the operation of the automatic operation apparatus for the ventilating fan in the above-mentioned embodiment with reference to FIG. 2.

First, at step 21, a smoke density Ka in the room 1 is inputted to the computer 14, and is stored in the reference value setting means 9. Next, at step 22, a smoke density Kb in the room after 30 seconds elapse is inputted into the microcomputer 14. Then, step 23, the first smoke density variation computing means 7 computes a smoke density variation Ma which is a difference between the smoke density Ka and the smoke density Kb which is detected after 30 seconds elapses from the time of the input of the value Ka. At step 24, whether the smoke density variation Ma is lager than a first set value R which has been stored in the microcomputer 14 or not is determined, and if it is determined to be smaller than the set value R, the procedure is returned to step 21. However if it is determined to be larger, the procedure is advanced to step 25 so as to start the operation of the ventilating fan 3. After the start of the operation of the ventilating fan 3, at step 26, the operation of the ventilating fan 3 is maintained for two minutes, irrespective of the degree of an inputted smoke density. Further, at step 27, a smoke density Kc which is measured after 30 seconds elapse from the completion of step 26, is inputted to the microcomputer 14. Then at step 28 the second smoke density variation computing means 11 computes a smoke density variation Mb in the room 1 after 30 seconds elapse from the completion of step 28 from the smoke density Ka and the smoke density reference value Ka stored in the reference setting means 9. Next, at step 29 whether the smoke density variation Mb is larger than a second set value L or not is determined, and if it is determined to be larger, the procedure is returned to step 27 at which a smoke density in the room after further 30 seconds elapse is inputted to the microcomputer 24. The procedure from step 27 to step 29 is repeated. Meanwhile, if it is determined to be smaller, the procedure is advanced to step 30 so that the operation of the ventilating fan 3 is stopped after the operation has been continued by 3 minutes. After the stopping of the operation of ventilating fan 3, at step 31, the stopping of the operation is maintained for 2 minutes, irrespective of the degree of a smoke density input value. After completion of step 3, the procedure is returned to step 21.

Thus, according to the automatic operation apparatus for the ventilating fan in the first embodiment of the present invention, even though the detection sensing characteristic of any smoke density detection element 5 to be used individually differ from that of another one by a same degree, the smoke density measuring means 6 measures a detection output from the used smoke density detection element 5 by every predetermined time, and the first smoke density variation computing means 7 computes a smoke density variation from the smoke density at that moment and an initially measured smoke density. Then when the variation exceeds the first set value, the operation starting means 8 starts the operation of the ventilating fan 3, and accordingly, the ventilating fan 3 can be automatically operated with a high degree of accuracy in accordance with the smoke density which is increased by generated smoke. Further, the reference value setting means 9 stores therein a smoke density initially measured by the smoke density measuring means as a reference value, and the second smoke density variation computing means 11 computes a smoke density variation from this reference value and a smoke density measured by the smoke density measuring means 6 after the start of the operation of the ventilating fan. When the smoke density variation becomes small than the second set value, the operation stopping means 13 stops the operation of the ventilating fan 3, and accordingly, the ventilating fan 3 can be automatically stopped with a high degree of accuracy in accordance with the smoke density which is decreased under ventilation. Further, upon the start of the operation of the ventilating fan, the temperature of the atmosphere surrounding the smoke density detection element 5 abruptly varies so that the detection output from the smoke density detection element 5 becomes unstable for a predetermined time. However, the operation maintaining means 10 maintains the operation of the ventilating fan 3 for the predetermined time, irrespective of the degree of a detection output from the smoke density detection element 5 so as to prevent the ventilating fan 3 from being erroneously operated. Further, upon the stop of the operation of the ventilating fan 3, although the temperature of the atmosphere of the smoke density detection element 5 abruptly varies so that the detection output from the smoke density detection element 5 becomes unstable for a predetermined time, the stop maintaining means 13 maintains the stop of the operation of the ventilating fan 3, irrespective of the degree of a detection output from the detection element 5, thereby it is possible to prevent the ventilating fan 3 from being erroneously operated.

Next explanation will be hereinbelow made of a second embodiment of the present invention. It is noted that like reference numerals are used to denote like parts to those explained in the first embodiment, and accordingly, the detailed explanation thereto will be abbreviated.

The feature of the second embodiment is the provision of a first set value correcting means 55 for lowering the first set value so that the variation computed by the first smoke density variation computing means 7 can easily exceed the first set value if a difference in smoke density occurs between the area surrounding the user and the area around the smoke density detection element 5 so that the ventilating fan 3 remains stopping for a predetermined time since the distance between the smoke density detection element 5 and a source of smoke is long so that the smoke from the source does not reach the smoke density detection element 5.

It is noted that the first set value correcting means 55, the smoke density measuring means 6, the first smoke density variation computing means 7, the operation starting means 8, the reference value setting means 9, the operation maintaining means 10, the second smoke density variation measuring means 11, the operation stopping means 12 and the stop maintaining means 13 are all materialized by a microcomputer 54.

Figure 4:
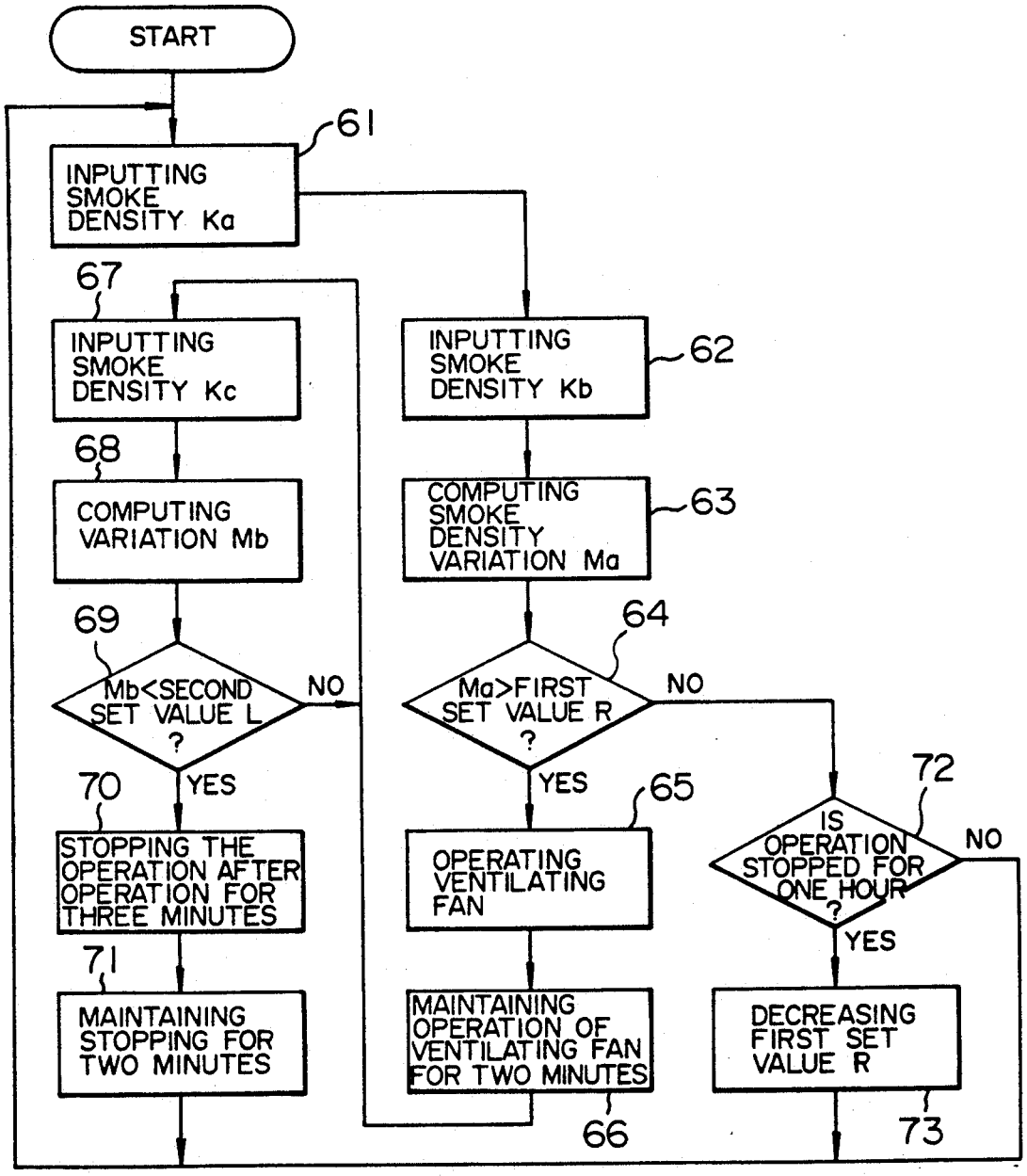
FIG. 4 is a flow chart explaining the operation program of the apparatus shown in FIG. 3.

Next, explanation will be hereinbelow made of the operation of the automatic operation apparatus for the ventilating fan in the second embodiment, in particular the operation of the first set value correcting means 55 with reference to FIG. 4.

At step 64, if it is determined that the smoke density variation Ma is smaller than the first set value R, the procedure is advanced to step 72 at which whether the ventilating fan 43 remains stopping more than one hour or not is determined in view of the fact that the smoke density variation Ma does not exceed the first set value R, and if it does not remain stopping more than one hour, the procedure is returned to step 61. However, if it remains stopping more than one hour, the procedure is advanced to step 73 at which the first set value R which has been beforehand stored in the microcomputer 54 is lowered by a predetermined value so as to allow the smoke density variation Ma to easily exceed the first set value R. After completion of step 73, the procedure is returned to step 61.

Thus, according to the automatic operation apparatus for the ventilating fan in the second embodiment of the present invention, if the variation Ma computed by the first smoke density variation computing means 7 does not become higher than the first set value R so that the ventilating fan 3 remains stopping for a predetermined time since the distance between the smoke density detection element 5 and the source of smoke is long so that the smoke does not reach the smoke density detection element 5, that is, a difference in smoke density occurs between the area surrounding the user and the area surrounding the smoke density detection element 5, the first set value correcting means 55 decreases the first set value R and accordingly, the variation Ma computed by the first smoke density variation computing means 7 can easily exceeds the first value R.

Figure 5:
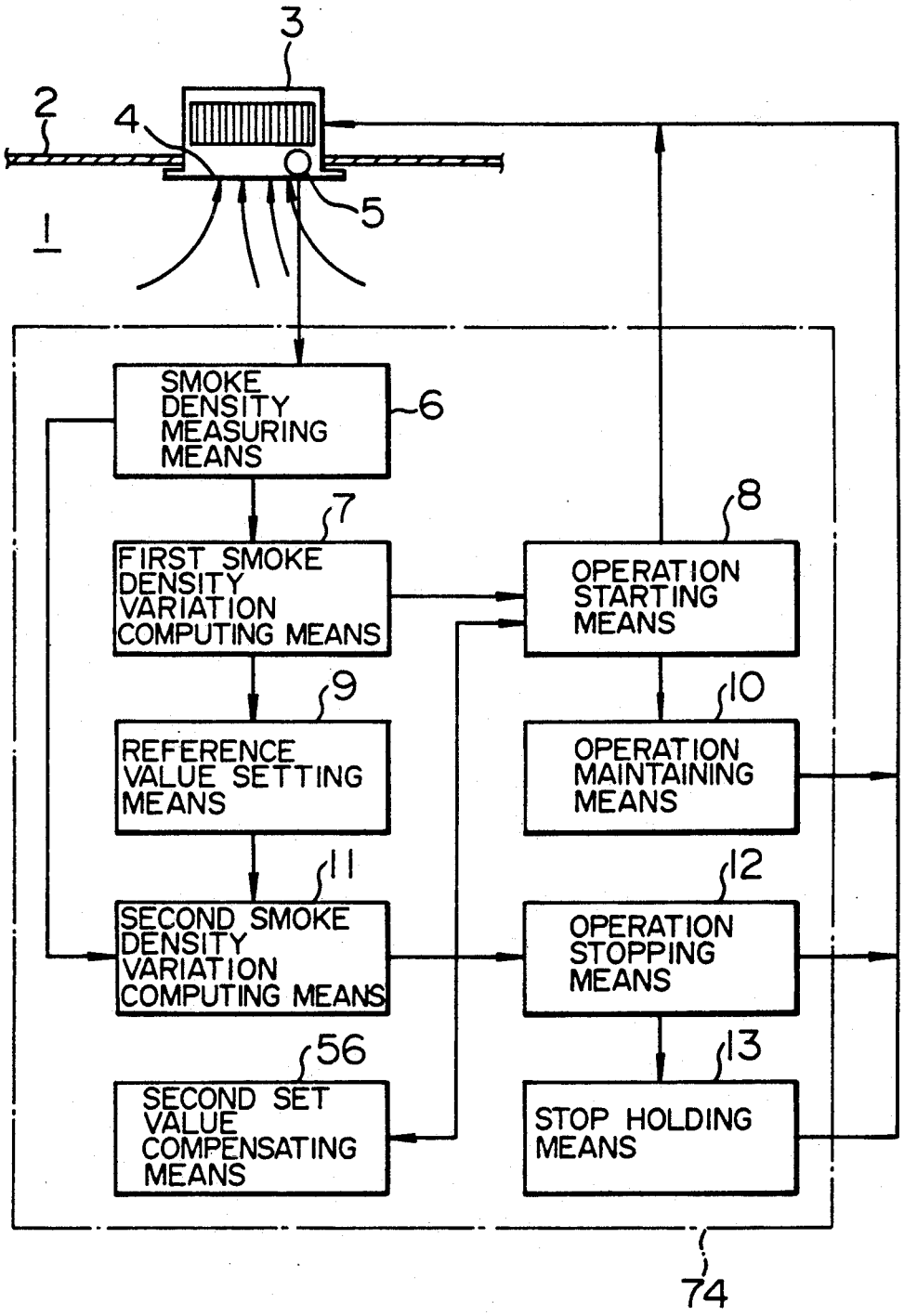
FIG. 5 is a block diagram showing an automatic operation apparatus in a third embodiment of the present invention.
Figure 6:
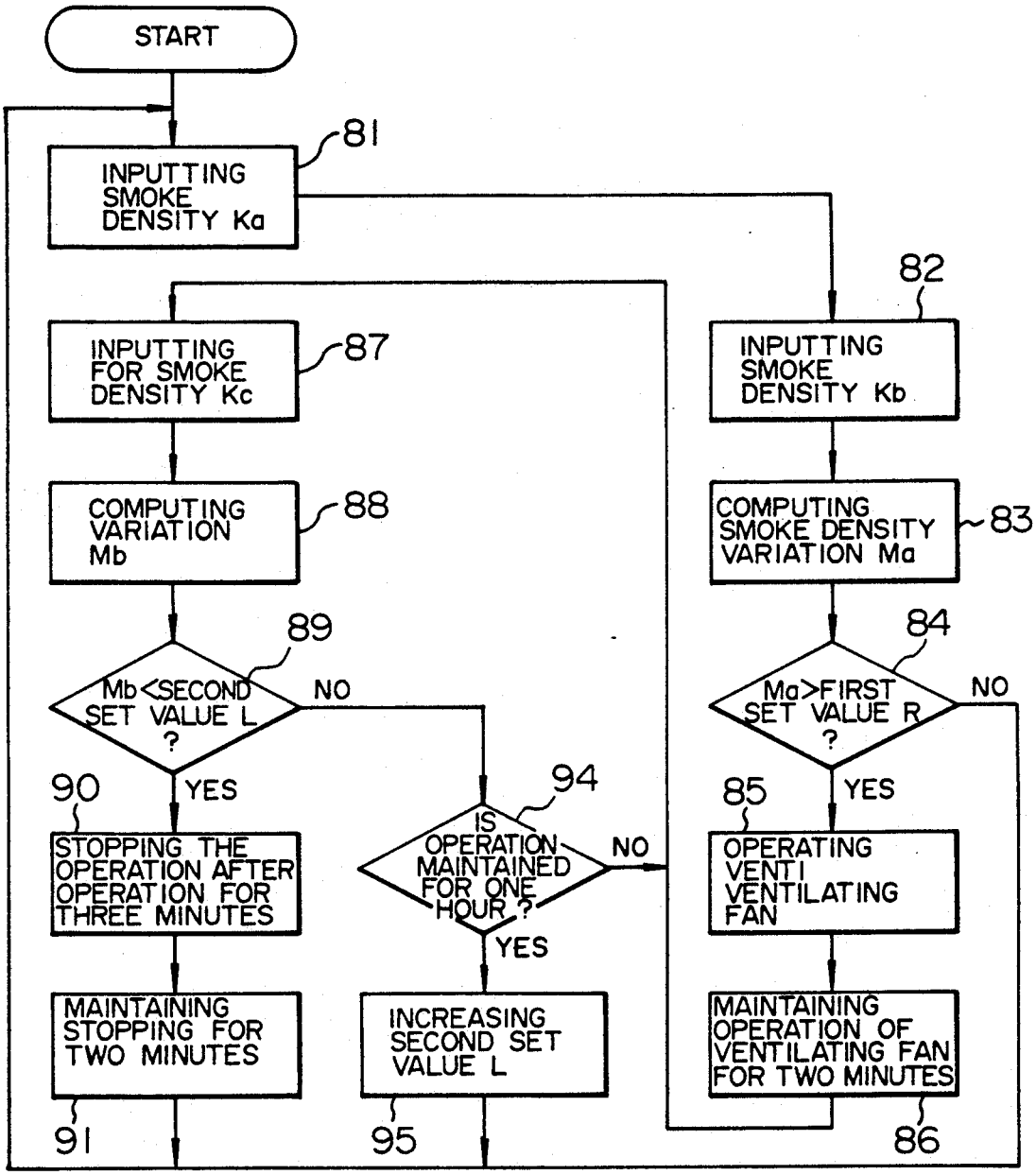
FIG. 6 is a flow chart explaining the operation program for the apparatus shown in FIG. 5.
Figure 7:
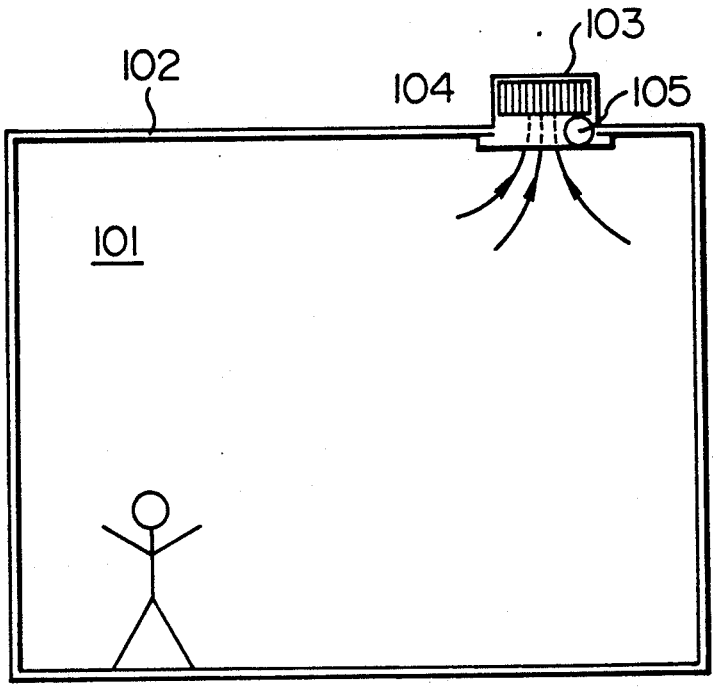
FIG. 7 is a block diagram showing a conventional automatic operation apparatus for a ventilating fan.
Figure 8:
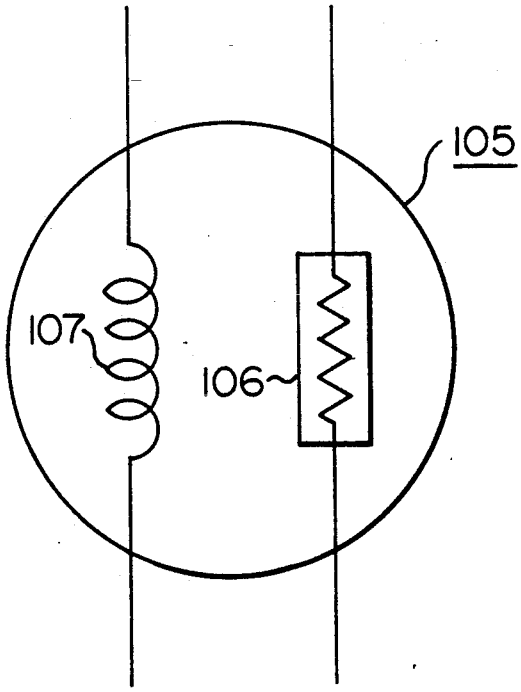
FIG. 8 is a schematic view illustrating a smoke density detecting element.
Figure 9:
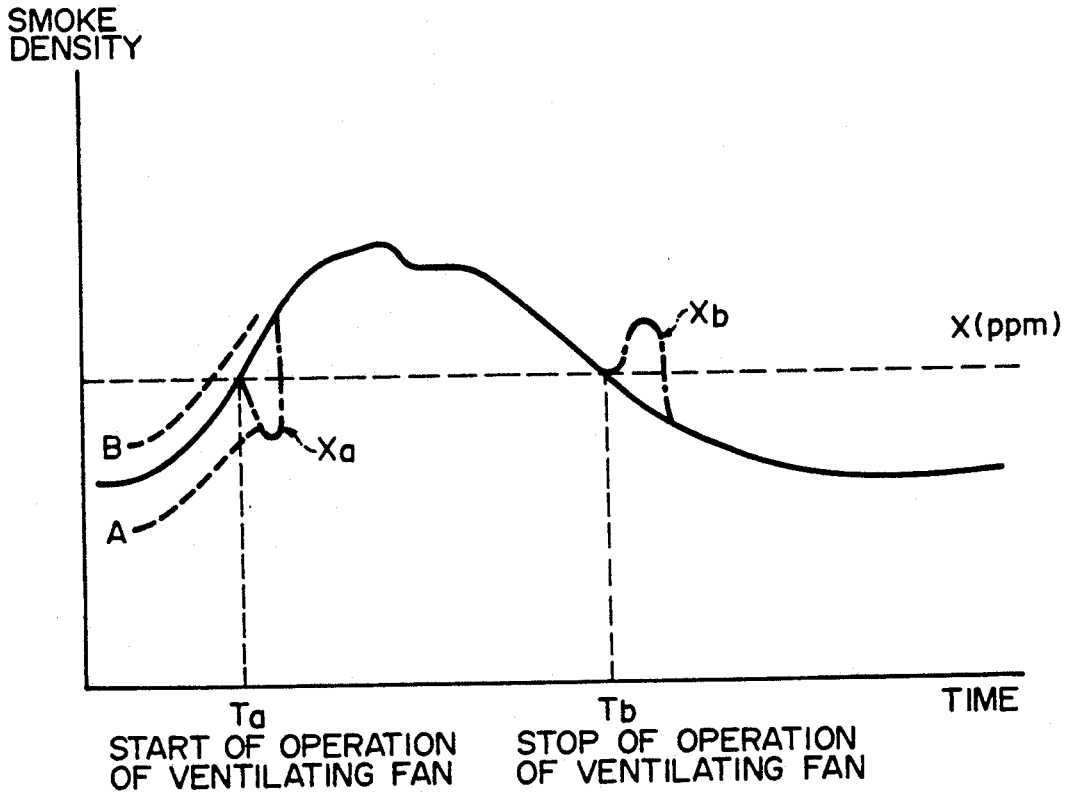
FIG. 9 is a graph showing a relationship between the elapsed time and the smoke density of the smoke density detecting element.

Then, explanation will be made hereinbelow a third embodiment of the present invention with reference to FIGS. 5 and 6. It is noted that like reference numerals are used to denote like parts to those explained in the first embodiment, and accordingly, detailed explanation thereto will be abbreviated, as in similar to the second embodiment.

The feature of the third embodiment is the provision of a second set value correcting means 56 for decreasing the second set value by a predetermined value so as to allow the variation computed by the second smoke density variation computing means 11 to easily become lower than the second set value if the variation computed by the second smoke density variation computing means 11 does not become lower than the second set value so that the ventilating fan remains operating for a predetermined time since the distance between the smoke density detection element 5 and the source of smoke is short so that smoke is soon sucked through the area around the smoke density detecting element 5 without being diffused into the air in the room upon operation of the ventilating fan 3, that is, a difference in smoke density occurs between the area surrounding the user and the area surrounding the smoke density detection element 5.

It is noted that the second set value correcting means 56, the smoke density measuring means 6, the first smoke density variation computing means 7, the operation starting means 8, the reference value setting means 9, the operation maintaining means 10, the second smoke density variation computing means 11, the operation stopping means 12 and the stop maintaining means 13 are all materialized by a microcomputer 74.

Then, explanation will be made hereinbelow of the operation of the automatic operation apparatus for the ventilating fan in the third embodiment, in particular, of the operation of the second set value correcting means in reference to FIG. 6.

At step 81, if it is determined that the smoke density variation Mb is smaller than the second set value L, the procedure is advanced to step 94 at which the ventilating fan 3 remains operating more than one hour or not is determined in view of the fact that it is not determined that the smoke density variation Mb is smaller than the second set value R at step 89. If it does not remain operating more than one hour, the procedure is returned to step 87, and then a smoke density in the room 1 which is detected after 30 seconds elapse is inputted to the microcomputer 74 so that the procedure from step 94 to step 87 is repeated. Further, if it remains operating more than one hour, the procedure is advanced to step 95, and the second set value L which has been stored beforehand in the microcomputer 74 is increased so as to allow the smoke density variation Mb to easily become below the second set value L. Further, after completion of step 75, the procedure is returned to step 87, and further a smoke density in the room 30 after a further elapse of 30 seconds is inputted into the microcomputer 74.

Thus, according to the automatic operation apparatus in the third embodiment of the present invention, if the variation computed by the second smoke density variation computing means 11 does not become lower than the second set value so that the ventilating fan 3 remains operating for a predetermined time since the distance between the smoke density detection element 5 and a source of smoke is short so that generated smoke soon sucked through the area around the smoke density detection element 5 without being diffused into the air in the room upon operation of the ventilating fan 3, that is, a difference in smoke density occurs between the area surrounding the user and the area around the smoke density detection element 5, the second set value correcting means 56 increases the second set value so that the variation value computed by the second smoke density variation computing means 11 can easily become below the second set value.

Although it has been explained in the above-mentioned embodiment that the detection output from the smoke density detection element 5 is measured by every 30 seconds, no substantial difference would be appreciated in the technical effects and advantages obtained thereby even though the time of the measuring is changed in accordance with the user's feeling.

Further, although it has been explained that just after the operation starting means 8 starts the ventilating fan 3, the operation maintaining means 10 maintains the operation of the ventilating fan 3 for two minutes, irrespective the degree of a smoke density input, no substantial change would be appreciated in the technical effects and advantages obtained thereby even though this operation maintaining period can be changed in accordance with a time in which the detection output from the smoke density detection element 5 becomes unstable.

Further, although it has been explained that the time used for increasing the first set value by the first set value correcting means 55 or for decreasing the second set value by the second set value correcting means 56 is set to be one hour, no substantial change would be appreciated in the technical effects and advantages obtained thereby even though the time of the measuring is changed in accordance with the user's feeling.

As is clear from the above-mentioned embodiments, according to the prevent invention, there can be provided a highly effective automatic operations apparatus for a ventilating fan, which can start and stop the operation of the ventilating fan, precisely is accordance with a density of generated smoke even though the detection sensing characteristic of an individual smoke density detection element to be used in the automatic operation apparatus for the ventilating fan differs individually that of another one, and which can prevent the ventilating fan from being erroneously operated being caused by an abrupt variation in the temperature of the atmosphere surrounding the smoke density detection element upon a start or stop of the operation of the ventilating fan.

Further, there can be provided an automatic operation apparatus for a ventilating fan which can Perform ventilation that suitably cope with an atmosphere surrounding the user even though generated smoke cannot reach the smoke density detection element, that is, a difference in smoke density occurs between the area surrounding the user and the area surrounding the smoke density detection element since the room in which the ventilating fan is installed has a wide space or the position of the installed ventilating fan is high so that the distance between the detection element and a source of smoke is long.

Further, there can be provided an automatic operation apparatus for a ventilating fan which can perform ventilation that suitably cope with an atmosphere surrounding the user even though generated smoke is soon sucked through the area around the smoke density detection element and is then discharge to the outside of the room without being diffused into the air in the room, that is, a difference in smoke density occurs between the area surrounding the user and the area around the smoke density detection element since the room in which the ventilating fan is installed has a narrow space or the position of the installed ventilating fan is low so that the distance between the area surrounding the user and the area around the smoke density detection element is short.

What is claimed is:

1. An automatic operation apparatus for a ventilating fan comprising:

a smoke density detection element for detecting a smoke density in a room;

a smoke density measuring means for measuring a detection output from said smoke density detection element for every predetermined time;

a first smoke density variation computing means for computing a variation in smoke density from a smoke density measured by said smoke density measuring means at that time and an initially measured smoke density used as a reference value;

an operation starting means for starting operation of said ventilating fan when the variation computed by said first smoke density variation computing means exceeds a first set value;

a reference value setting means for storing therein said initially measured smoke density as a reference value;

an operation maintaining means for maintaining the operation of said ventilating fan, irrespective of a detection output from said smoke density measuring element, until a predetermined time elapses after the operation of said ventilating fan is started;

a second smoke density variation computing means for computing a variation in smoke density from a smoke density measured by said smoke density measuring means and the reference value stored in said reference value setting means after the predetermined time elapses;

an operation stopping means for stopping the operation of said ventilating fan when the variation computed by said second smoke density variation computing means becomes lower than a second set value; and a stop maintaining means for maintaining stopping of the operation of said ventilating fan, irrespective a detection output from said smoke density detecting element until a predetermined time elapse after the operation of the ventilating fan is stopped by said operation stopping means.

2. An automatic operation apparatus for a ventilating fan as set forth in claim 1, further comprising a first set value correcting means for decreasing the first set value if the variation computed by said first smoke density variation computing means does not exceed said first set value so that said ventilating fan is maintained in a stopping condition for a predetermined time.

3. An automatic operation apparatus for a ventilating fan as set forth in claim 2, further comprising a second set value correcting means for increasing the second set value if the variation computed by said second smoke density variation computing means does not become lower than the second set value so that said ventilating fan is maintained in an operating condition for a predetermined time.

* * * * *